US009297553B2

(12) United States Patent
Vallejo Noriega et al.

(10) Patent No.: US 9,297,553 B2
(45) Date of Patent: Mar. 29, 2016

(54) PUMP ASSEMBLY

(71) Applicant: Whirlpool Corporation, Benton Harbor, MI (US)

(72) Inventors: Alvaro Vallejo Noriega, Saint Joseph, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 347 days.

(21) Appl. No.: 13/932,086

(22) Filed: Jul. 1, 2013

(65) Prior Publication Data

US 2015/0003818 A1 Jan. 1, 2015

(51) Int. Cl.

| | |
|---|---|
| ***F24H 1/08*** | (2006.01) |
| ***F24H 1/10*** | (2006.01) |
| ***F24H 9/20*** | (2006.01) |
| ***F01D 25/14*** | (2006.01) |
| ***F04D 29/58*** | (2006.01) |
| *F04D 29/44* | (2006.01) |

(52) U.S. Cl.

CPC ..... *F24H 9/2028* (2013.01); *F01D 25/14* (2013.01); *F04D 29/586* (2013.01)

(58) Field of Classification Search

None

See application file for complete search history.

(56) References Cited

U.S. PATENT DOCUMENTS

| | | | | |
|---|---|---|---|---|
| 1,750,170 | A * | 3/1930 | Frisch | 417/238 |
| 2,694,769 | A | 11/1954 | Huck et al. | |
| 4,594,500 | A * | 6/1986 | Wright | 392/471 |
| 4,924,069 | A * | 5/1990 | Giordani | 392/485 |
| 5,692,885 | A * | 12/1997 | Langer | 417/420 |
| 6,736,598 | B2 | 5/2004 | Kleemann et al. | |
| 7,287,536 | B2 * | 10/2007 | Steck et al. | 134/107 |
| 7,293,958 | B2 * | 11/2007 | Kraffzik | 415/206 |
| 7,455,065 | B2 | 11/2008 | Schrott | |
| 7,560,672 | B2 * | 7/2009 | Pleschinger et al. | 219/545 |
| 7,965,928 | B2 * | 6/2011 | Eichholz et al. | 392/417 |
| 8,245,718 | B2 * | 8/2012 | Busing et al. | 134/108 |
| 8,989,566 | B2 * | 3/2015 | Liu et al. | 392/471 |
| 2015/0044073 | A1 * | 2/2015 | Badafem et al. | 417/313 |
| 2015/0086325 | A1 * | 3/2015 | Koebrich et al. | 415/1 |

FOREIGN PATENT DOCUMENTS

| | | | |
|---|---|---|---|
| DE | 20208544 | U1 | 7/2002 |
| DE | 202008015058 | U1 | 2/2009 |
| EP | 1247993 | B1 | 3/2009 |

OTHER PUBLICATIONS

European Search Report for Corresponding EP14173784.1, Oct. 29, 2014.

* cited by examiner

*Primary Examiner* — Thor Campbell

(57) ABSTRACT

A pump assembly includes a motor and a pump, with the motor having an output shaft that extends into a volute chamber defined by a housing of the pump. An impeller may be mounted to the end of the output shaft. A heating element maybe located within a projection formed in an end of the housing and defines a heat transfer area confronting the volute chamber, wherein heat generated by the heating element may be conducted into the volute chamber.

18 Claims, 5 Drawing Sheets

PUMP ASSEMBLY

BACKGROUND OF THE INVENTION

Household appliances, in particular a dishwasher or the like, have a treating chamber through which treating liquid, like a wash liquid, may be recirculated during a treating cycle of operation. A pump is often used to recirculate the liquid in the liquid circuit, with the pump typically being of the impeller-type, with a motor rotatably driving the impeller, which is enclosed within a housing or casing to fluidly isolate the impeller from the pump and form a liquid or volute chamber about the impeller. The casing typically has an axial inlet and a radial outlet whereby liquid is provided to the radial center of the impeller, which then expels the liquid radially outwardly to the outlet.

In cases where the liquid is heated, a heating element may be provided on the casing for heating the liquid within the liquid chamber. The heating element has a heat conducting contact area, which when the heating element may be energized, conducts heat to the liquid within the liquid chamber.

BRIEF DESCRIPTION OF THE INVENTION

In one aspect, a pump assembly includes a motor having an output shaft, an impeller mounted to the output shaft, a housing enclosing the impeller and defining a volute chamber and having a plurality of convolutions defining a heat transfer area confronting the volute chamber, and a heating element provided on an exterior of the housing and in heat transfer proximity to the convolutions, wherein heat generated by the heating element is conducted into the volute chamber through the plurality of convolutions.

DESCRIPTION OF EMBODIMENTS OF THE INVENTION

The invention may be implemented in any environment using a pump assembly for heating and transferring liquid. While the illustrated pump assembly has particular utility in a dishwashing machine, the pump assembly may be also applicable to any appliance configured to use heated liquid.

Figure 1:
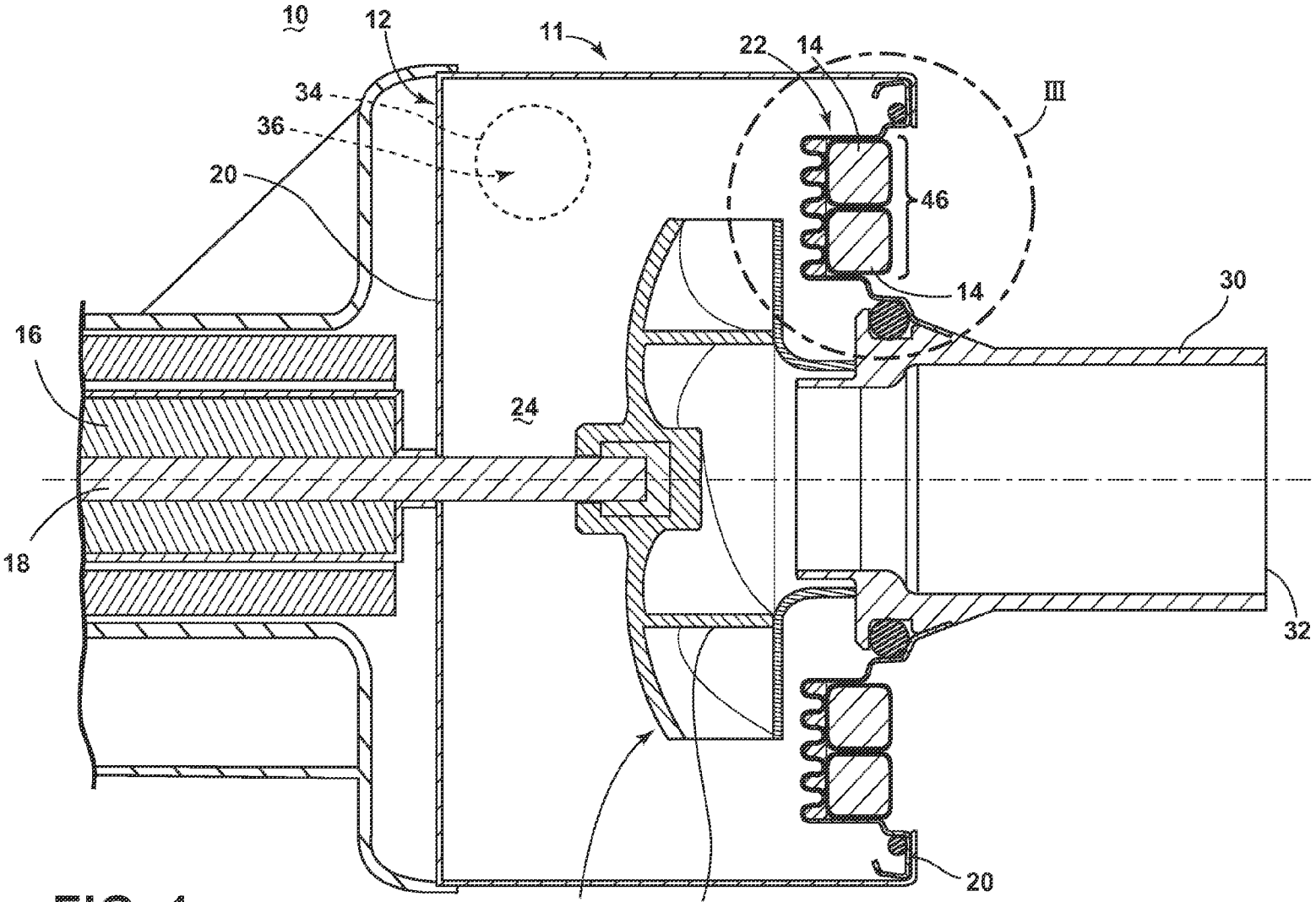
FIG. 1 is a sectional view illustrating a portion of the pump assembly with a heating element according to the first embodiment of the invention.

FIG. 1 illustrates a pump assembly 10 according to the first embodiment of the invention. The pump assembly 10 may be functionally divided into a motor 16 and a pump 11 having a housing 12, which couples the pump to the motor 16 and defines a volute chamber 24. A heating element 14 is provided on the housing 12. The motor 16 includes an output shaft 18 that extends into the volute chamber 24. The pump 11 further includes an impeller 26, having impeller blades 28, located within the volute chamber 24 and is mounted or coupled with the output shaft 18, such that the rotation of the output shaft 18 by the motor 16 rotates the impeller 26. The impeller blades 28 are configured such that the rotation of the impeller 26 by the motor 16 defines a centrifugal pump for moving liquid about the housing 12.

The pump 11 additionally includes an inlet passageway 30, having an opening 32, coupled to an end of the housing 12, and an outlet passageway 34, having an opening 36, coupled in a side of the housing 12. A portion of the housing projects into the volute chamber 24 to define a projection 22 confronting the volute chamber 24, which also defines an exterior channel 46 in which the heating element 14 is at least partially received. The housing 12, volute chamber 24, sidewalls 20, and inlet and outlet passageways 30, 34 are arranged in a watertight configuration such that the rotation of the impeller 26 receives liquid within the opening 32 of the inlet passageway 30, and forcibly moves the liquid into the volute chamber 24, past the sidewall 20 having a projection 22, and out the opening 36 of the outlet passageway 34. In this sense, the projection 22 may have at least one side in fluid contact with the volute chamber 24, or liquid therein, and is shown having three sides in fluid contact. The passage of the output shaft 18 is sealed off in a manner not illustrated in greater detail.

The heating element 14, illustrated as a calrod, may be configured to use an energizable power source to generate heat, and is provided on the exterior of the housing 12, wherein the element 14 may be received by at least a portion of the projection 22. Although one such example of a heating element 14 is described as a calrod, many different heating elements may be acceptable in embodiments of the current invention.

Figure 2:
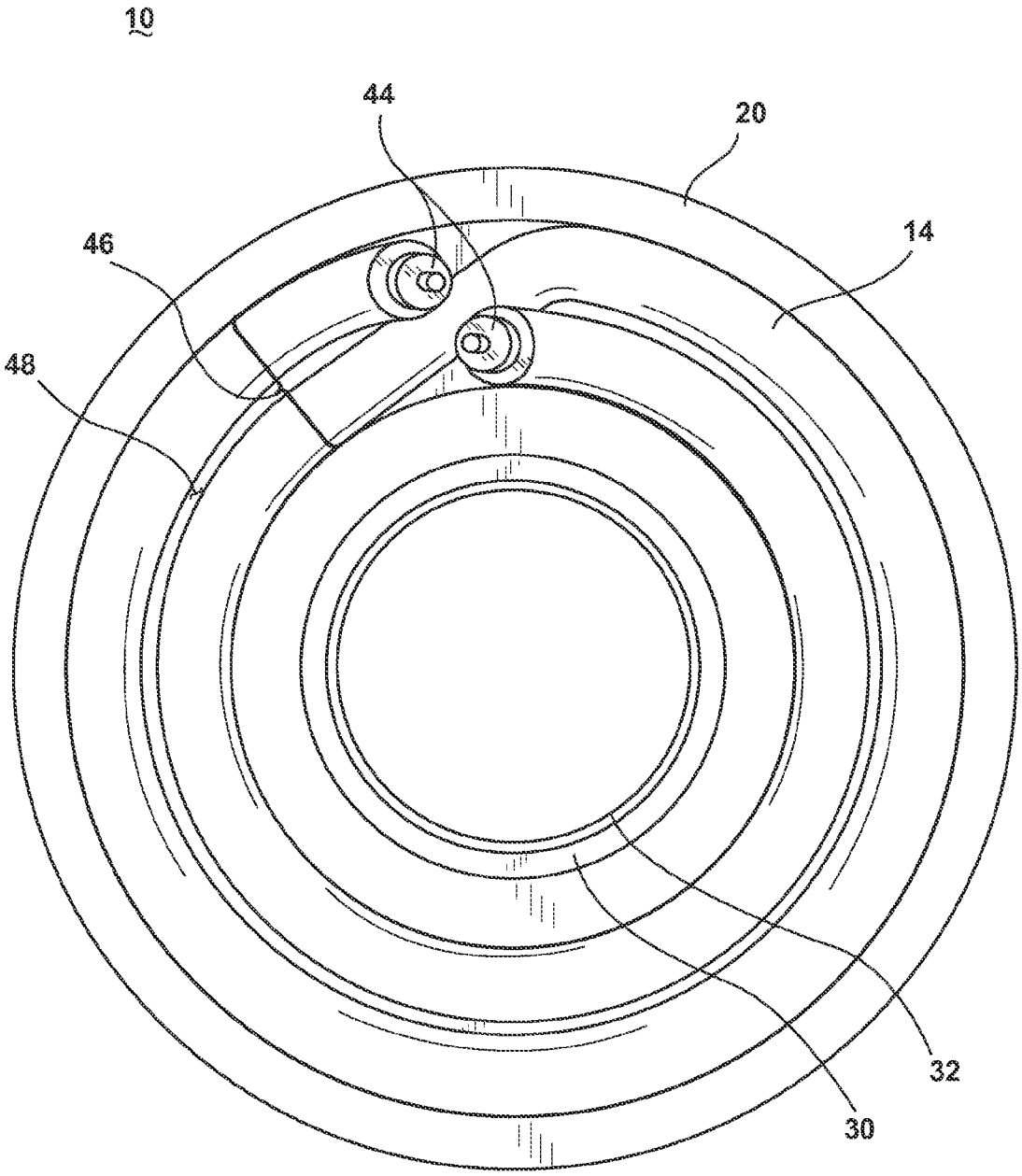
FIG. 2 is an end view, taken along line 2-2 of FIG. 1, showing the heating element resting in the projection according to the first embodiment of the invention.

FIG. 2 shows an end view, taken along line 2-2 of FIG. 1, illustrating the pump assembly 10, according to the first embodiment of the invention. As shown, the sidewall 20 having the projection 22 defines a substantially circular surface, having a continuous annular groove, for example, a channel 46, corresponding to a radial segment of the opposing side of the projection 22. At least a portion of the channel 46 may be at least twice as wide as the heating element 14.

A dually wound heating element 14 is shown positioned within the channel 46 such that the element 14 contains more than one cross sectional segment within a cross sectional plane in at least a portion of the channel 46 or projection 22. As shown, rotational segments of the dually wound heating element 14 are separated by at least a gap 48. Alternative patterns of positioning a heating element 14 within at least a portion of the channel 46 are envisioned. For example, the heating element 14 may have more than two windings, or a zig-zag winding (i.e. in short, radially inward and outward segments) within the channel 46. In another example, dual heating elements 14 may be configured to encircle the channel 46 in a similar dual-winding pattern. In yet another example, a single heating element 14 may be configured in more than one winding pattern.

Figure 3:
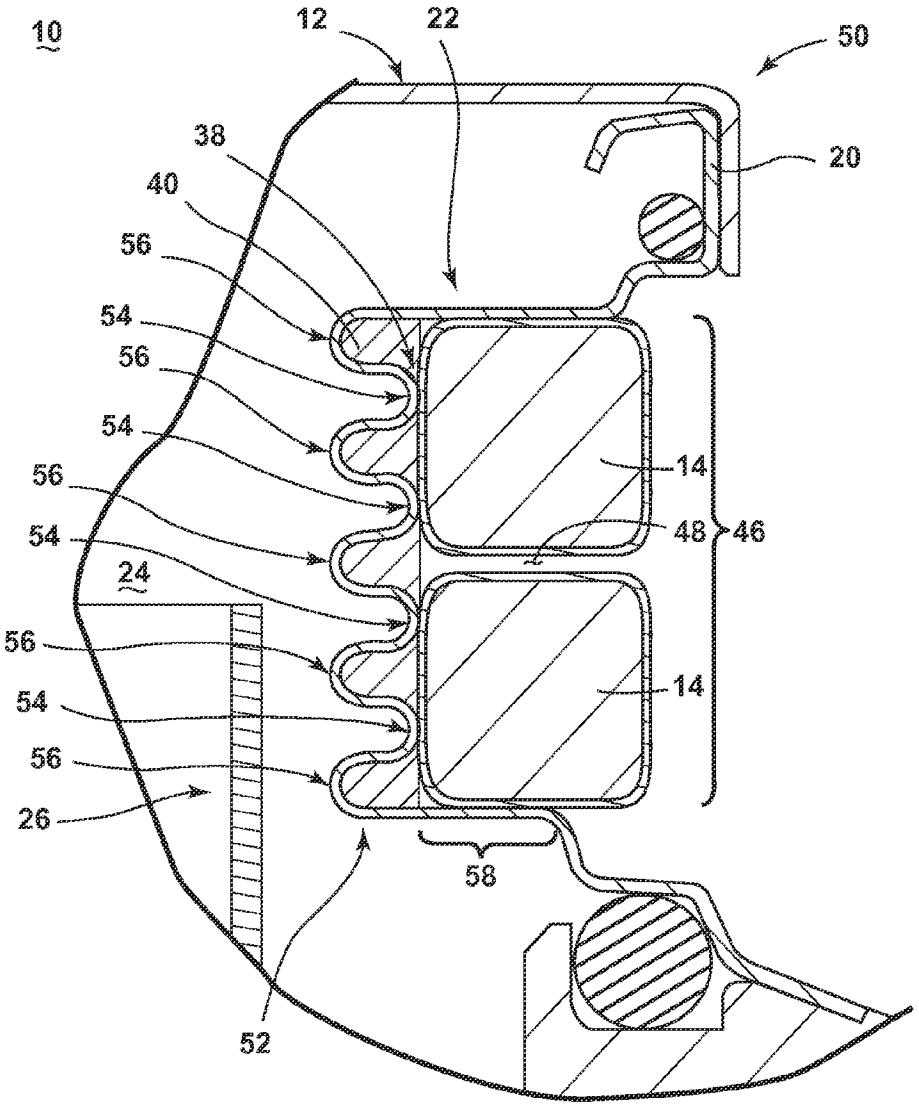
FIG. 3 illustrates an enlarged detail section III of FIG. 1 showing the heat transfer area according to the first embodiment of the invention.

The heating element 14 further includes terminating end caps 44 that may be used to electrically couple the element 14 with the energizable power source (not shown). Alternative methods of heat supply and corresponding end caps 44 are envisioned As best seen in FIG. 3, a gap 48 may be formed between the dually wound heating elements 14, with the outer surfaces of the heating elements 14 abutting the portion of the housing 12 forming the heater seat 38. As shown, the heater seat 38 conforms to the shape of the heating element 14.

The projection 22 may further include a plurality of convolutions 52 having peaks 54 and valleys 56, with at least a portion of the valleys 56 extending away from the projection 22 such that the valleys 56 are not in direct contact with the heating element 14. The peaks 54 may define at least a portion of the heater seat 38, wherein the peaks 54 and heating elements 14 are thermal coupled. The space between the heating element 14 and valleys 56 of the convolutions 52 may additionally be filled with an optional filling material, such as a thermally conductive brazing material 40, wherein the filling material may include a portion of the heater seat 38. While not illustrated, a brazing material 40 may fill the gap 48 between the heating element 14 segments. Alternatively, the heating element 14 may not be physical received by the heater seat 38, so long as the element 14 may be proximately located to provide for heat transference from the element 14 to the projection 22.

While the convolutions 52 are only shown on one side of the projection 22, the convolutions 52 may be provided on any or more of the three sides of the projection 22 in fluid contact with the volute chamber 24. Additionally, in embodiments where the projection 22 may have an alternate cross sectional shape, which may not have well-defined sides, it is envisioned at least a portion of the projection 22 may have the convolutions 52.

The configuration of the heating element 14 and convolutions 52 defines a heat transfer area 50 operably increasing the surface area of the heater seat 38 that is in conductive contact with the volute chamber 24, which in turn increases the rate at which heat is transferred to the liquid. The increased rate of heat transfer to the liquid is provided without increasing the corresponding size of the heating element 14. The filling of the valleys 56 with brazing material 40 further enhances the conductive transfer as heat is conducted to the convolutions 52, where otherwise the heat would first transfer by convection with the air in the valleys before conduction to the liquid.

The depth 58 to which the projection may extend into the volute chamber may vary. As illustrated, the depth 58 is slightly greater than half the height of the heating element 14. However, the depth 58 can be more or less, and can even include a depth greater than the height of the heating element 14. While the depth 58 is illustrated as more than half the height of the heating element 14, the amount of cross section area of the heating element in contact with the heater seat is less than fifty percent, a greater or lesser amount of the surface of the heating element may be in contact with the heater seat.

During operation of the pump assembly 10, the motor 16 operatively rotates the impeller 26 such that the liquid within the housing 12 traverses through the volute chamber 24, past the sidewall 20 having the projection 22. A power or heating source selectively energizes the heating element 14, causing the heating element 14 to generate heat. The heat generated by the heating element 14 may be thermally conducted through the channel 46, heater seat 38, brazing material 40 (if present), convolutions 52 and any non-convoluted sides of the projection 22, to the volute chamber 24, and consequently, to the traversing liquid as it flows past the projection 22 on its path to the outlet passageway 34.

The traversing liquid will pass through the peaks 54 and valleys 56 of the convolutions 52, which provides an increased surface area, and consequently, an increased heat transfer area 50 and enhanced rate of conduction, as compared to a flat surface. Due to the enhanced rate of conduction at the heat transfer area 50 in the current embodiments, a heating element 14 may be selected such that the thermal output of the heating element 14 is greater, because it is not limited to the conduction rate of a flat wall.

Figure 4:
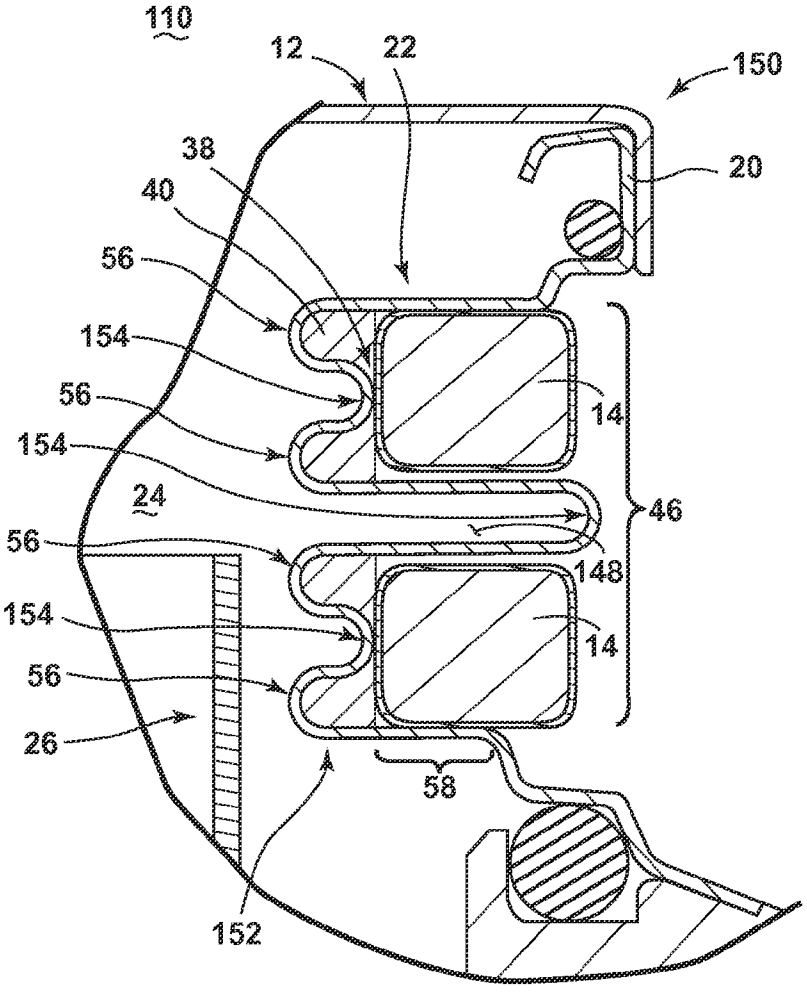
FIG. 4 is a view similar to FIG. 3 and illustrates an alternative structure for the heating element and casing according to the second embodiment of the invention.

Furthermore, FIG. 4 illustrates a pump assembly 110 according to a second embodiment of the invention. The second embodiment may be similar to the first embodiment; therefore, like parts will be identified with like numerals increased by 100, with it being understood that the description of the like parts of the first embodiment applies to the second embodiment, unless otherwise noted. A difference between the first embodiment and the second embodiment may be that the heat transfer area 150 includes convolutions 152 having at least one peak 154 that extends into the gap 148 between the dually wound heating element 14. Additionally the space between the heating element 14 and the convolutions 152 may be filled with an optional brazing material 40.

Figure 5:
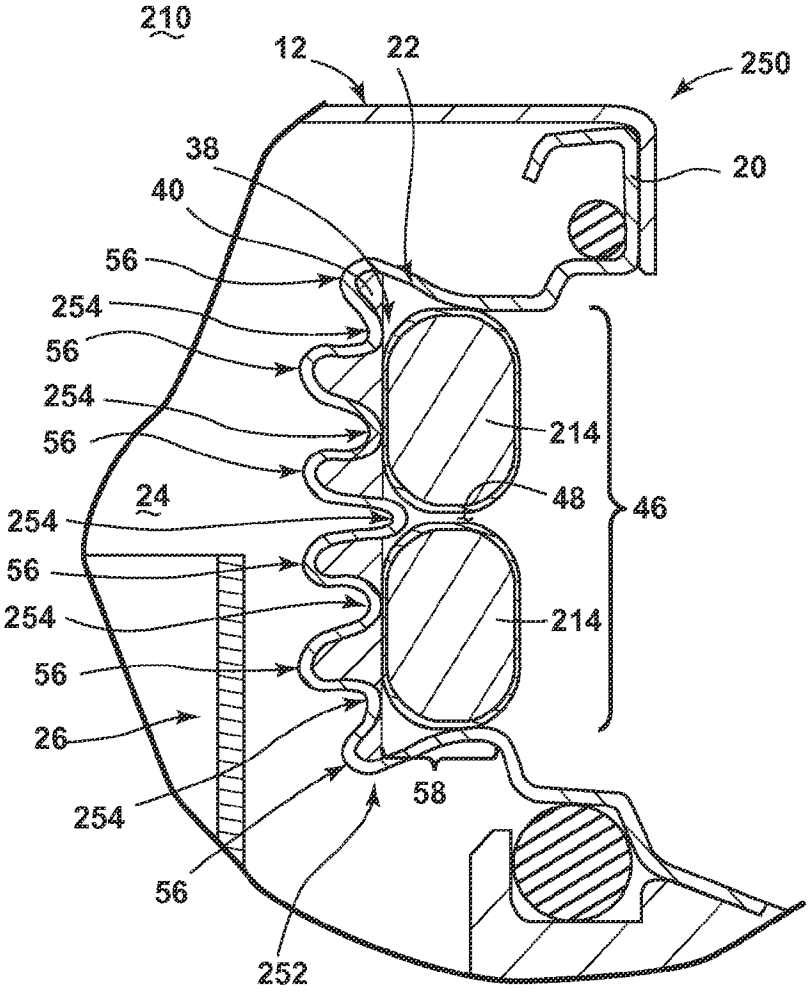
FIG. 5 is a view similar to FIGS. 3 and 4 and illustrates an alternative structure for the heating element and casing according to the third embodiment of the invention.

FIG. 5 illustrates a pump assembly 210 according to a third embodiment of the invention. The third embodiment may be similar to the first two embodiments; therefore, like parts will be identified with like numerals increased by 200, with it being understood that the description of the like parts of the prior embodiments apply to the third embodiment, unless otherwise noted. A difference between the third embodiment and the first and second embodiments may be that the heating element 214 has an ovate cross section. Additionally, the convolutions 252 of the heat transfer area 250 are shown conforming to the alternative heating element 214 cross sectional shape. Alternatively, the convolutions 252 may continue to use a more planar conformation regardless of the heating element 214 cross sectional shape, such as the convolutions 52 shown in the first embodiment. Additionally, alternate cross sectional shapes are envisioned.

Figure 6:
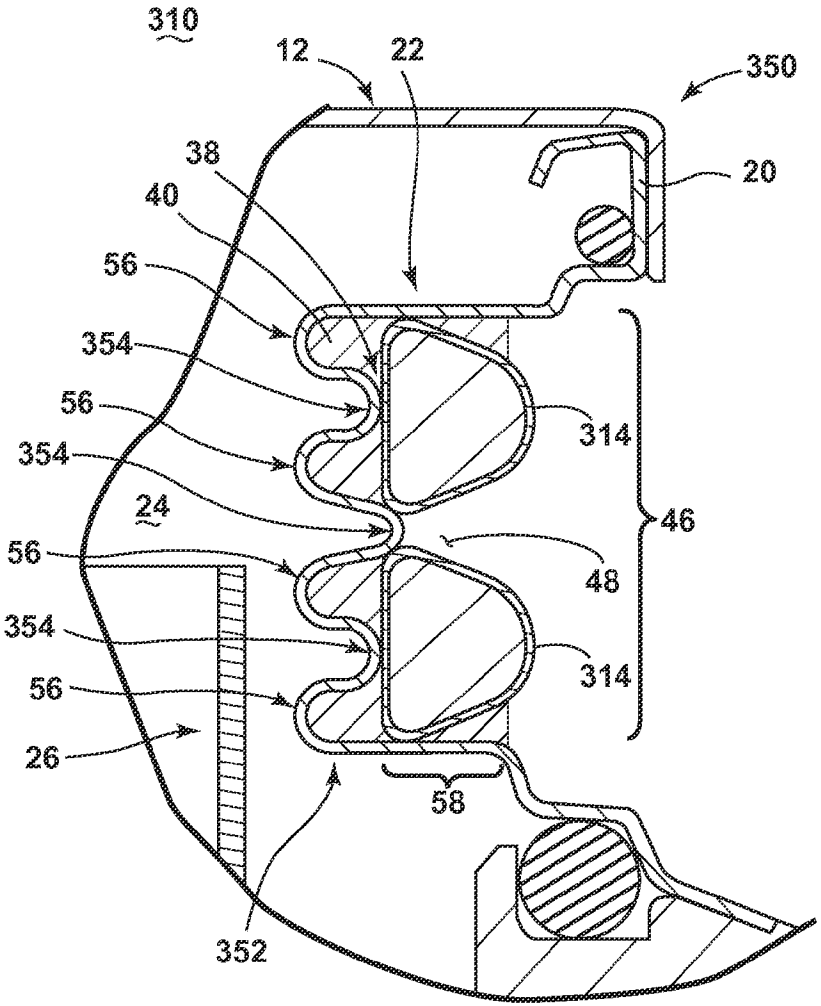
FIG. 6 is a view similar to FIGS. 3, 4, and 5 and illustrates an alternative structure for the heating element and casing according to the fourth embodiment of the invention.

FIG. 6 illustrates a pump assembly 310 according to a fourth embodiment of the invention. The fourth embodiment may be similar to the first three embodiments; therefore, like parts will be identified with like numerals increased by 300, with it being understood that the description of the like parts of the prior embodiments apply to the fourth embodiment, unless otherwise noted. A difference between the fourth embodiment and the first, second, and third embodiments may be that the heating element 314 has a triangular-like cross section, wherein the triangular tip away from the convolutions 352 is rounded. Additionally, the convolutions 352 of the heat transfer area 350 are shown conforming to the alternative heating element 314 cross sectional shape.

Many other possible embodiments and configurations in addition to that shown in the above figures are contemplated by the present disclosure. For example, one embodiment of the invention contemplates a pump assembly 10 having a non-centrifugal pump. Another embodiment of the invention may position the heating element 14 such that there may be no gap 48 between the dually wound elements 14. Furthermore, while the inlet opening 32 may be provided in an end of the housing 12 opposite the impeller 26, and the projection 22 may be provided at the end of the housing 12, alternate configurations are envisioned wherein the position of various components are rearranged so long as the liquid path interacts with the projection 22 so the described heating may occur. Additionally, the design and placement of the various components may be rearranged such that a number of different in-line configurations could be realized.

The embodiments disclosed herein provide a pump assembly. Calcium precipitates out of water at higher temperatures, creating water scale at or near the heating element in a pump. One advantage that may be realized in the above embodiments is that the above described embodiments allow for an elongated heating element surface area, and thus generating heat over a larger heat transfer area. This operatively reducing the watt density of the heat transfer area by distributing a known wattage over a longer length, which in turn, reduces calcium precipitation while heating the liquid. Another advantage of the above embodiments may be that the effective heat transfer from the heating element to the liquid may be further increased using the optional heat-transferring brazing material. Yet another advantage of the above embodiments may be that the increased heat transfer surface area of the plurality of convolutions 52 further increases the effective heat transfer of the heating element and brazing material, and further reduces the watt density of the heating element. Even yet another advantage of the above embodiments may be that any calcium or water scale that does develop at the heat transfer area will harden and break off during the thermal expansion and contraction at the convex surfaces of the peaks and valleys of the convolutions. In another advantage of the above described embodiments, the projection's depth into the volute chamber increases the heat transfer area, further reducing the watt density of the heating element To the extent not already described, the different features and structures of the various embodiments may be used in combination with each other as desired. That one feature may not be illustrated in all of the embodiments may be not meant to be construed that it may not be, but may be done for brevity of description. Thus, the various features of the different embodiments may be mixed and matched as desired to form new embodiments, whether or not the new embodiments are expressly described. All combinations or permutations of features described herein are covered by this disclosure. The primary differences among the exemplary embodiments relate to a pump assembly, and these features may be combined in any suitable manner to modify the above described embodiments and create other embodiments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A pump assembly comprising:

a motor having an output shaft;

an impeller mounted to the output shaft;

a housing configured to enclose the impeller and defining a volute chamber and includes a projection that defines a channel having a plurality of convolutions defining alternating peaks and valleys extending from the projection that define a heat transfer area that confronts the volute chamber; and a heating element provided on an exterior of the housing, at least partially received in the channel, and in heat transfer proximity to the convolutions;

wherein the channel conforms to the shape of the heating element and heat generated by the heating element is conducted into the volute chamber through the plurality of convolutions.

2. The pump assembly of claim 1 wherein the peaks that form an exterior of the housing define at least a portion of a heater seat on which at least a portion of the heating element rests.

3. The pump assembly of claim 2, further comprising a filling material provided within the valleys that form an exterior of the housing.

4. The pump assembly of claim 3 wherein the filling material comprises a portion of the heater seat.

5. The pump assembly of claim 4 wherein the heater seat conforms to the shape of the heating element.

6. The pump assembly of claim 5 wherein the heating element comprises at least one of a rectilinear and ovate cross section.

7. The pump assembly of claim 1 wherein the channel has at least a portion at least twice as wide as the heating element, and the heating element has two segments within the portion of the channel.

8. The pump assembly of claim 1 wherein the projection forms a continuous channel.

9. The pump assembly of claim 8 wherein the continuous channel is substantially circular.

10. The pump assembly of claim 1 wherein the projection is located on an end of the housing opposite the impeller.

11. The pump assembly of claim 1 wherein an end of the housing defines an end surface and a portion of the channel lies between the end surface and the impeller.

12. The pump assembly of claim 11 wherein the portion of the channel is of a depth at least equal to the height of the heating element.

13. The pump assembly of claim 1 wherein the depth of the channel is greater than the height of the heating element.

14. The pump assembly of claim 1 wherein the projection comprises at least three sides in fluid contact with the volute chamber, and the convolutions are provided on at least one of the three sides.

15. The pump assembly of claim 14 wherein the convolutions are provided on at least two of the three sides.

16. The pump assembly of claim 1 wherein an inlet opening is provided in an end of the housing opposite the impeller, an outlet opening is provided in a side of the housing, and the projection is located between the inlet opening and the outlet opening.

17. The pump assembly of claim 16 wherein the projection is provided in the end of the housing.

18. The pump assembly of claim 1 wherein less than 50% of the cross section of the heating element contacts the channel.

* * * * *